US008051507B2

(12) United States Patent
Lin

(10) Patent No.: US 8,051,507 B2
(45) Date of Patent: Nov. 8, 2011

(54) EASY MAINTENANCE SENSING TYPE AUTOMATIC FAUCET

(76) Inventor: Ming-Shuan Lin, Taichung Hsien (TW)

( * ) Notice: Subject to any disclaimer, the term of this patent is extended or adjusted under 35 U.S.C. 154(b) by 623 days.

(21) Appl. No.: 12/256,558

(22) Filed: Oct. 23, 2008

(65) Prior Publication Data

US 2010/0101017 A1 Apr. 29, 2010

(51) Int. Cl.
*E03C 1/05* (2006.01)

(52) U.S. Cl. ..... 4/677; 4/623; 4/695; 137/603

(58) Field of Classification Search ..... 4/619, 623, 4/675–678, 695; 200/238; 137/315.12, 562, 137/603, 801
See application file for complete search history.

(56) References Cited

U.S. PATENT DOCUMENTS 5,010,917 A * 4/1991 Iqbal ..... 137/454.6
5,095,934 A * 3/1992 Iqbal ..... 137/270
5,749,393 A * 5/1998 Yang ..... 137/454.2
6,073,972 A * 6/2000 Rivera ..... 285/64
6,286,808 B1 * 9/2001 Slothower et al. ..... 251/118
7,445,024 B2 * 11/2008 Paterson et al. ..... 137/606
2006/0174955 A1 * 8/2006 Huang ..... 137/625.17
2010/0126609 A1 * 5/2010 Chung ..... 137/603

* cited by examiner

*Primary Examiner* — David Dunn
*Assistant Examiner* — Sirous Anvari
(74) *Attorney, Agent, or Firm* — Panitch Schwarze Belisario & Nadel LLP

(57) ABSTRACT

A faucet includes a mounting unit and a valve unit. The mounting unit includes a fixed seat and a rotatable seat rotatable relative to the fixed seat. The fixed seat is formed with a plurality of inverted L-shaped retaining hooks. The valve unit includes a housing, a coupling member disposed in the housing, a valve seat, an electromagnetic valve, and an infrared sensor. The coupling member includes a plurality of L-shaped retaining grooves engaging respectively the retaining hooks. The retaining hooks can be removed from the retaining grooves to allow for maintenance and replacement of the valve unit.

6 Claims, 7 Drawing Sheets

EASY MAINTENANCE SENSING TYPE AUTOMATIC FAUCET

BACKGROUND OF THE INVENTION

1. Field of the Invention

This invention relates to a faucet mounted on a deck, and more particularly to an easy maintenance faucet that can be removed easily from a deck.

2. Description of the Related Art

Referring to FIG. 1, an easy maintenance faucet disclosed in French Patent Number FR2835005 B1 includes a fixed member 1, a valve block 2 rotatable on the fixed member 1, a valve body unit 3, and a bolt 4. The valve body unit 3 includes a bottom housing 301 covering and attached fixedly to the fixed member 1 by the bolt 4, a valve seat 302 fixed on the bottom housing 301, a connecting member 303 disposed in the valve seat 302 and co-rotatable with the valve block 2, a controlling member 304 disposed in the valve seat 302, and a lever 305 operable to activate the controlling member 304. The housing 301 can be removed easily from the fixed member 1 by removing the bolt 4 to allow for maintenance and replacement of the valve block 2 and the valve body unit 3.

However, such an easy maintenance structure cannot be applied to a sensing type automatic faucet, such as a position sensing faucet, since an electromagnetic valve, a sensor, and water seals used for waterproofing of the electromagnetic valve and the sensor are difficult to be mounted therewithin.

SUMMARY OF THE INVENTION

The object of this invention is to provide an easy maintenance sensing type automatic faucet.

According to this invention, an easy maintenance sensing type automatic faucet includes a mounting unit and a valve unit. The mounting unit includes a fixed seat and a rotatable seat rotatable relative to the fixed seat. The fixed seat is formed with a plurality of inverted L-shaped retaining hooks. The valve unit includes a housing, a coupling member disposed in the housing, a valve seat, an electromagnetic valve, and an infrared sensor. The coupling member includes a plurality of L-shaped retaining grooves engaging respectively the retaining hooks. The retaining hooks can be removed from the retaining grooves to allow for maintenance and replacement of the valve unit.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
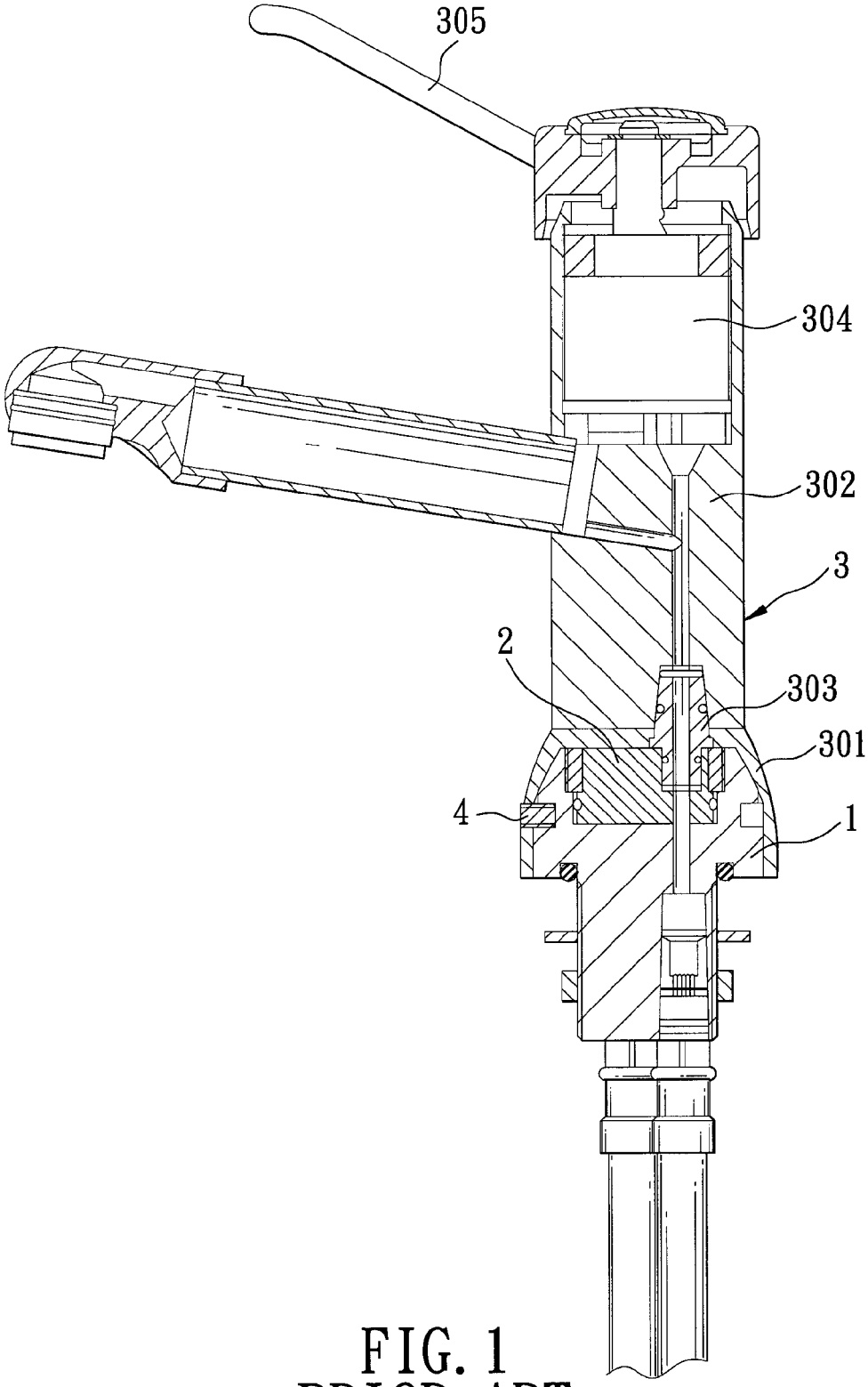
FIG. 1 PRIOR ART
FIG. 1 a sectional view of a conventional faucet disclosed in French Patent Number FR2835005 B1.
Figure 2:
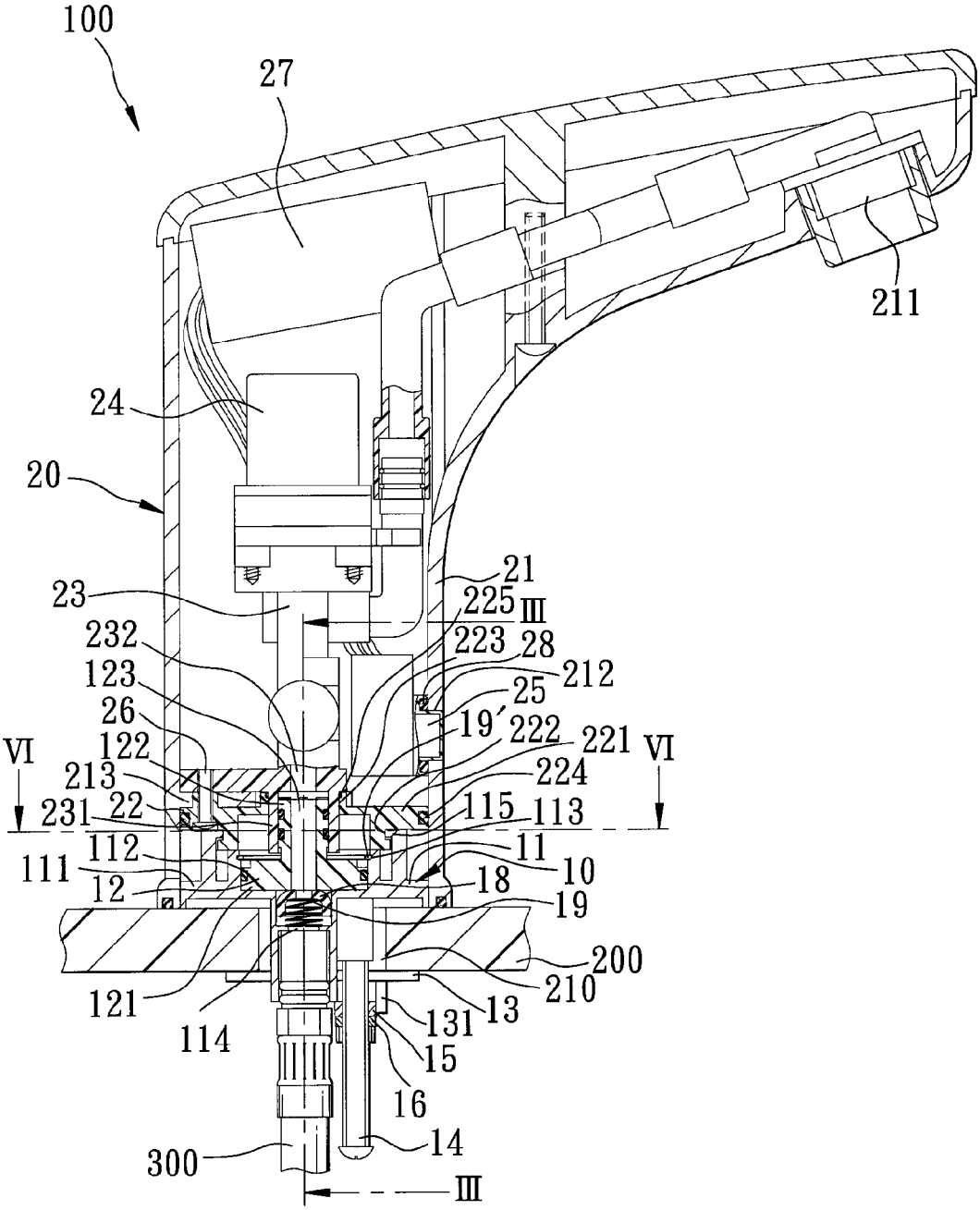
FIG. 2 is a sectional view of the preferred embodiment of an easy maintenance sensing type automatic faucet according to this invention.
Figure 3:
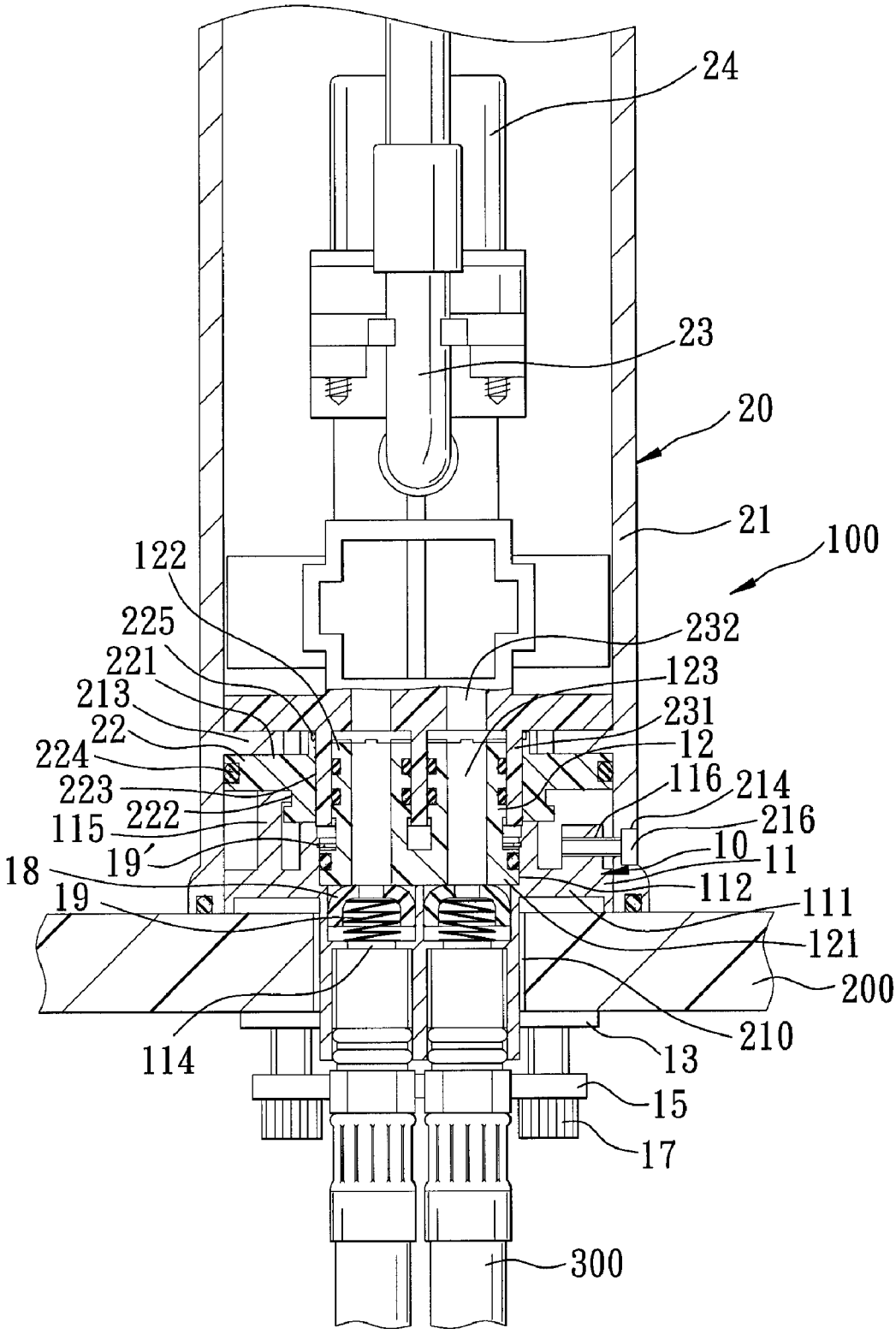
FIG. 3 is a sectional view taken along Line III-III in FIG. 2.
Figure 4:
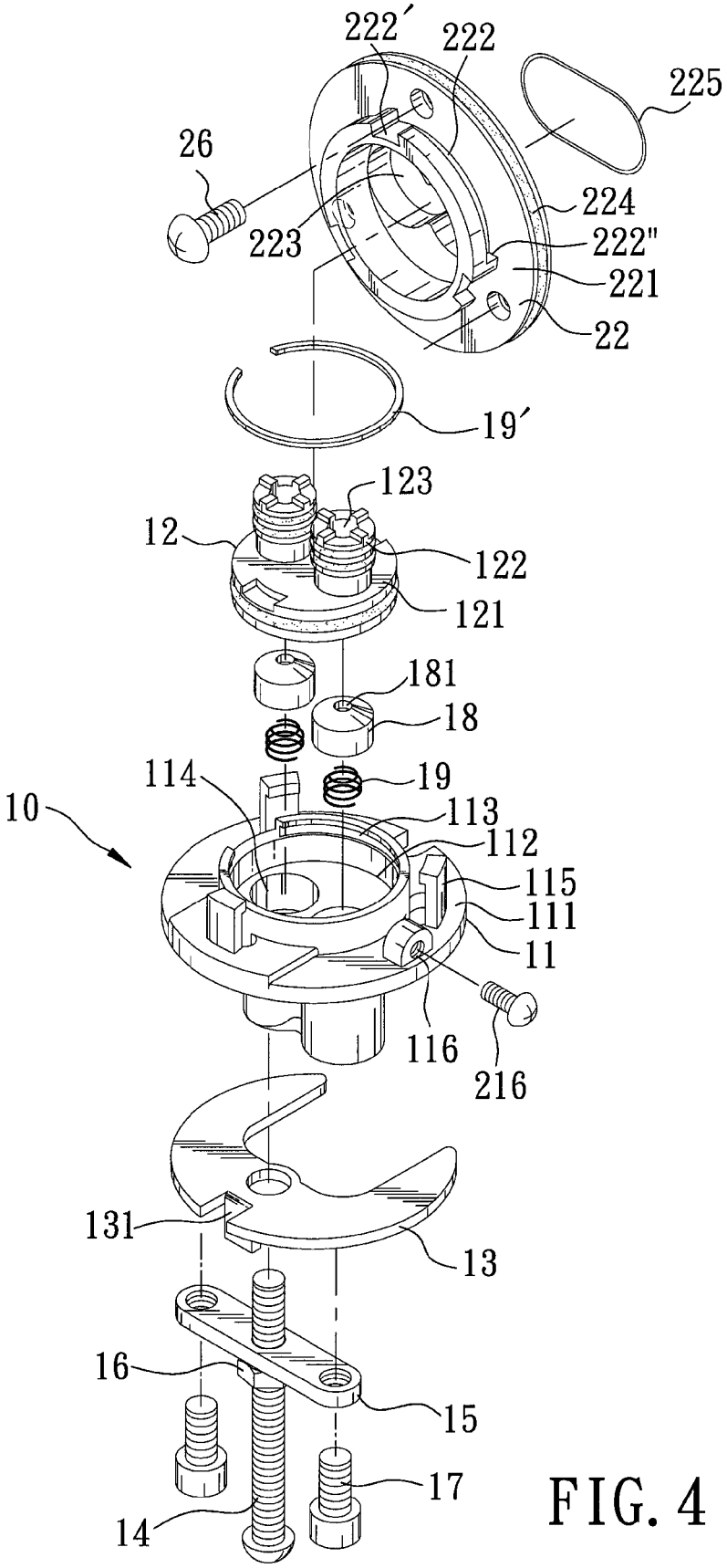
FIG. 4 is a fragmentary, partly exploded perspective view of the preferred embodiment.

Referring to FIGS. 2, 3, and 4, an easy maintenance sensing type automatic faucet 100 according to this invention is mounted to a deck 200, and is communicated fluidly with a water source (not shown) by two conduits 300. The deck 200 has a mounting hole 210. The faucet 100 includes a mounting unit 10, a valve unit 20, and a lock unit configured as a lock bolt 216. The mounting unit 10 is disposed on the deck 200, and is aligned with the mounting hole 210. The mounting unit 10 includes a fixed seat 11, a rotatable seat 12, a lower plate 13, a first bolt 14, a positioning plate 15, a nut 16, two second bolts 17, two rubber caps 18, two resilient members 19, and a C-shaped retaining ring 19'. The fixed seat 11 includes an upper plate 111, a recess 112 formed in a top surface of the upper plate 111, a groove 113 formed in an inner surface, two water-guiding holes 114 having lower ends respectively in fluid communication with the conduits 300 and upper ends in fluid communication with the recess 112, and a plurality of inverted L-shaped retaining hooks 115 disposed around the recess 112 and the water-guiding holes 114. The upper plate 111 is disposed on and above the deck 200, and is formed with a radially extending threaded hole 116. The rotatable seat 12 has a disk portion 121 received fittingly and rotatably within the recess 112, and two tubular projections 122 projecting upwardly from the disk portion 121 and formed respectively with two guide passages 123. The C-shaped retaining ring 19' is received within the groove 113 and abuts against a top surface of the disk portion 121 so as to allow for rotation of the rotatable seat 12 relative to the fixed seat 11 while preventing axial movement of the rotatable seat 12 relative to the fixed seat 11. The lower plate 13 is disposed immediately under the deck 200. The first bolt 14 extends through the lower plate 13 and into the mounting hole 210 in the deck 200, and is connected threadedly to the fixed seat 11. The positioning plate 15 is disposed under the lower plate 13. The first bolt 14 extends fittingly through the positioning plate 15. The nut 16 engages the first bolt 14. The positioning plate 15 is disposed on and above the nut 16. The lower plate 13 is formed with a stop block 131 abutting against the positioning plate 15 so as to prevent rotation of the positioning plate 15 about the first bolt 14. The second bolts 17 are threaded in the positioning plate 15 for pressing the lower plate 13 against the deck 200. As such, the deck 200 is clamped between the upper and lower plates 111, 13 so that the fixed seat 11 is disposed fixedly on the deck 200. The rubber caps 18 are received respectively and fittingly within top ends of the water-guiding holes 114. Each of the rubber caps 18 has an annular top end wall defining an aperture 181. The resilient members 19 are disposed respectively within the water-guiding holes 114 for biasing the top end wall of the rubber caps 18 to press against the disk portion 111 such that each of the water-guiding holes 114 is in fluid communication with the corresponding guide passage 123 through the corresponding aperture 181.

The valve unit 20 includes a housing 21, a coupling member 22 disposed in the housing 21, a valve seat 23, an electromagnetic valve 24, an infrared sensor 25, and a battery set 27. The housing 21 includes a water outlet 211 at a top end portion thereof, an opening 212 disposed below the water outlet 211, a spacer plate 213 disposed fixedly in the housing 21 and below the opening 212, and a fastener hole 214 aligned with the threaded hole 116. The coupling member 22 includes a top wall 221 attached fixedly to the spacer plate 213 by bolts 26, a plurality of L-shaped retaining grooves 222 disposed under the top wall 221 and engaging respectively the retaining hooks 115, a through hole 223 aligned with the guide passages 123, a first water seal 224 disposed between the top wall 221 and the housing 21 so as to establish a liquid tight seal therebetween, and a second water seal 225 disposed between the top wall 221 and the valve seat 23 so as to establish a liquid tight seal therebetween. Each of the L-shaped retaining grooves 222 has an open end 222' and a closed end 222". The valve seat 23 is also attached fixedly to the spacer plate 213 by bolts 26, and includes two connecting portions 231 extending through the through hole 223 and sleeved respectively on the tubular projections 122. Each of the connecting portions 231 is formed with a water inlet 232 in fluid communication with the corresponding guide passage 123 and the water outlet 211. The electromagnetic valve 24 is disposed on the valve seat 23 and between the water outlet 211 and the water inlets 232 for controlling outflow of water through the water outlet 211. The infrared sensor 25 is disposed within the opening 212 in the housing 21, and is connected electrically to the electromagnetic valve 24 for controlling activation and deactivation of the electromagnetic valve 24. The battery set 27 is disposed in the housing 21 for supplying electricity to the electromagnetic valve 24 and the infrared sensor 25. The valve unit 20 further includes a third water seal 28 disposed in the opening 212 in the housing 21 and between the infrared sensor 25 and the housing 21 so as to establish a liquid tight seal therebetween.

Figure 5:
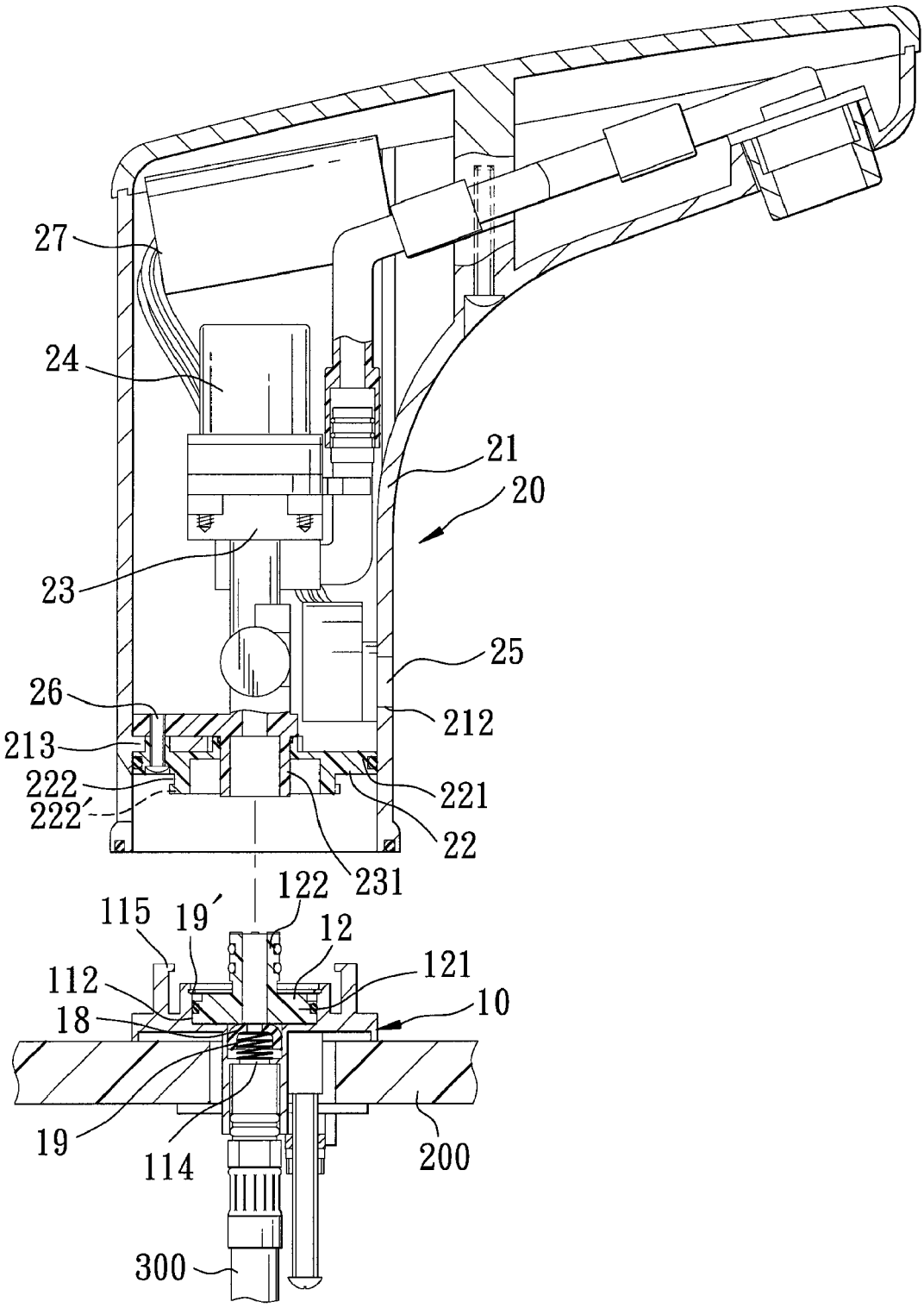
FIG. 5 is a fragmentary, partly sectional view of the preferred embodiment, illustrating how a valve unit is removed from a mounting unit.
Figure 6:
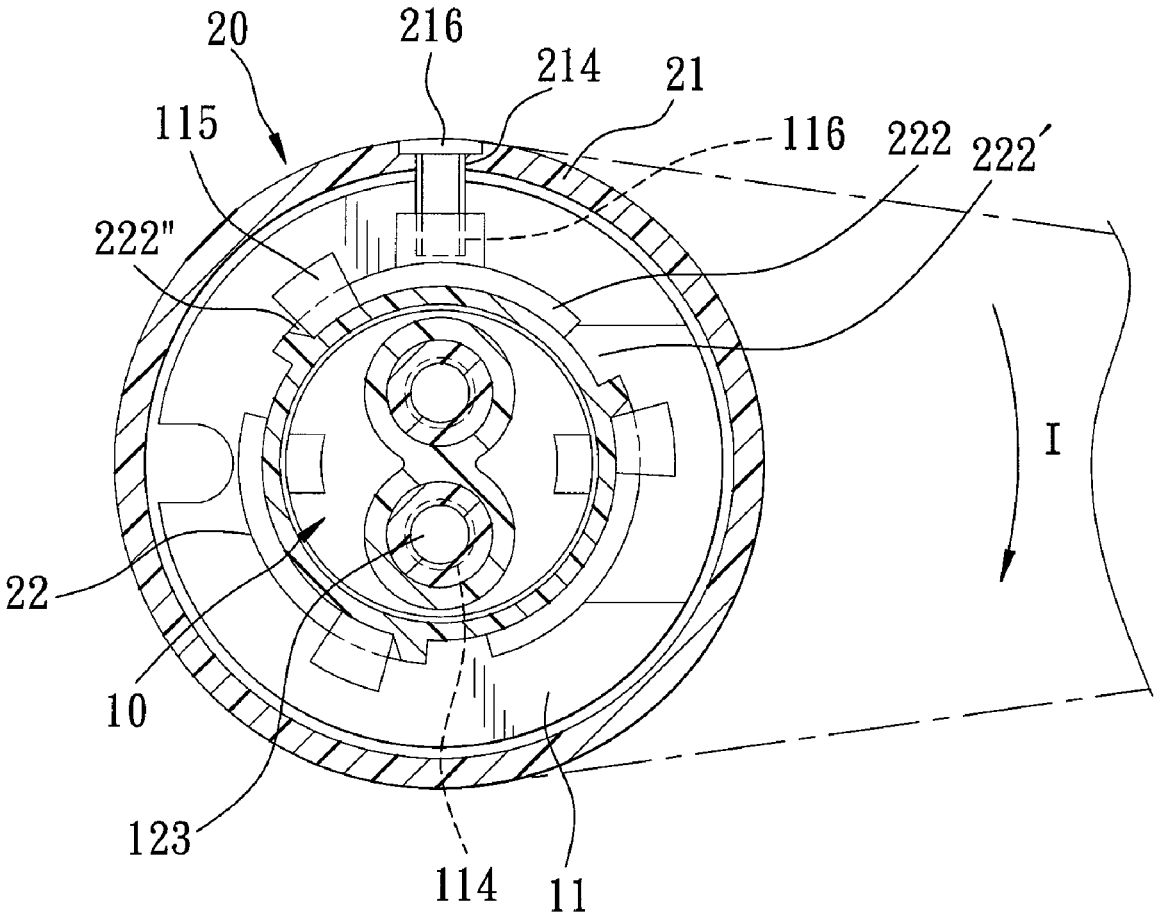
FIG. 6 is a sectional view taken along Line VI-VI in FIG. 2, illustrating how the valve unit is rotated relative to the mounting unit in a first direction to engage a plurality of retaining hooks with closed ends of a plurality of retaining grooves, respectively.
Figure 7:
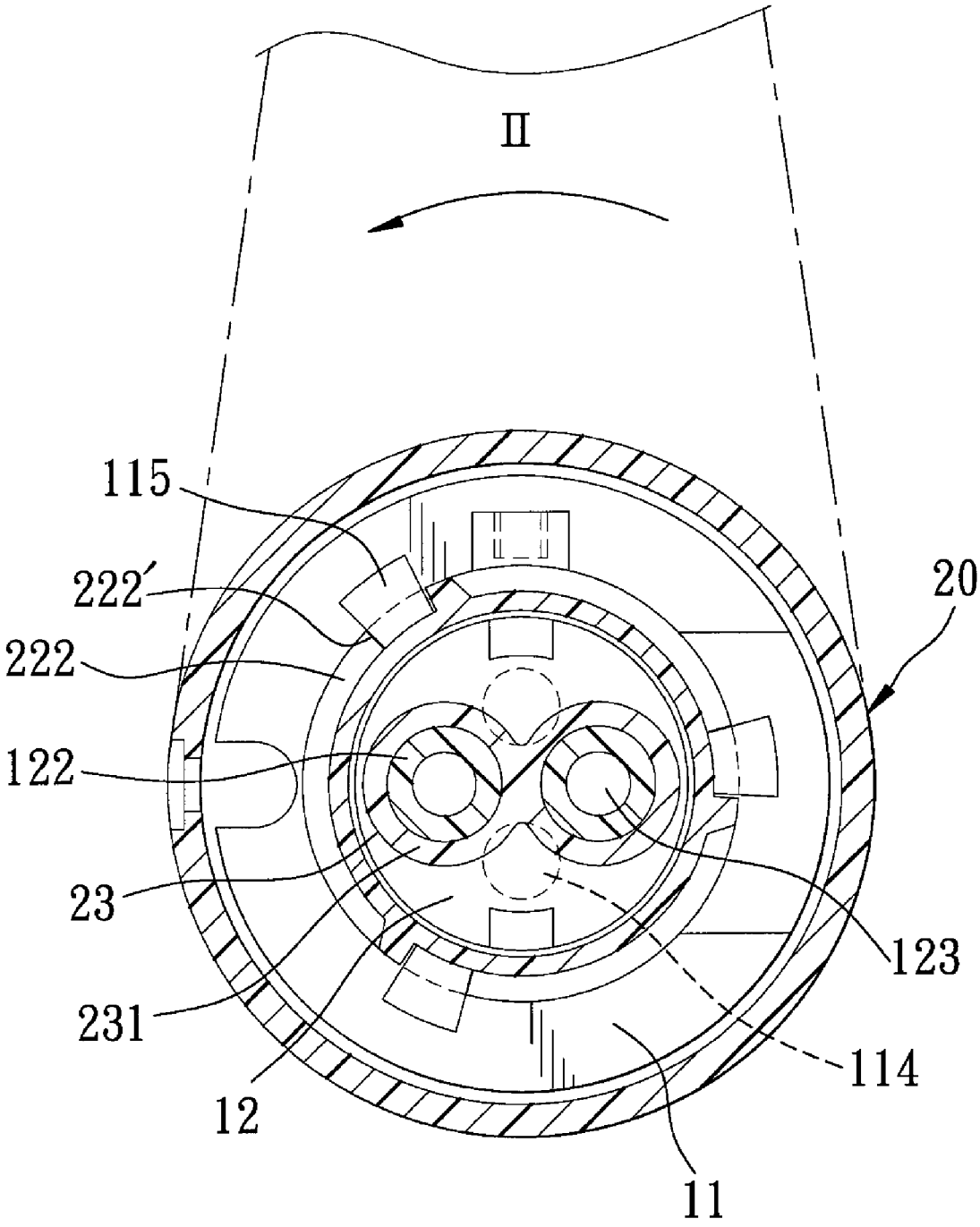
FIG. 7 is a view similar to FIG. 6 but illustrating how the rotatable unit is rotated relative to the mounting unit in a second direction to engage the retaining hooks with open ends of the retaining grooves, respectively, thereby allowing for removal of the retaining hooks from the retaining grooves, respectively.

During assembly, the mounting unit 10 is first mounted to the deck 200, as shown in FIG. 5. Next, the valve unit 20 is moved to engage the retaining hooks 115 with the open ends 222' of the retaining grooves 222, respectively, and sleeve the connecting portions 231 of the valve seat 23 on the tubular projections 122 of the mounting unit 10, respectively, as shown in FIG. 7. Afterwards, the valve unit 20 is rotated in a first direction (I) (see FIG. 6) to move the retaining hooks 115 into the closed ends 222" of the retaining grooves 222, respectively, as shown in FIG. 6. Finally, the lock bolt 216 is passed through the fastener hole 214 in the housing 21 to engage the threaded hole 116 to thereby retain the housing 21 on the mounting unit 10. When the retaining hooks 115 are disposed respectively at the closed ends 222" of the retaining grooves 222, each of the guide passages 123 is in fluid communication with the corresponding water-guiding hole 114 to thereby allow for outflow of water through the water outlet 211.

When maintenance or replacement of the valve unit 20 is desired, the lock bolt 216 is removed, and the valve unit 20 is rotated relative to the mounting unit 10 in a second direction (II) (see FIG. 7) that is opposite to the first direction (I), so as to move the retaining hooks 115 from the closed ends 222" of the retaining grooves 222 into the open ends 222' of the retaining grooves 222 to thereby allow for removal of the valve unit 20 from the mounting unit 10. As a consequence, the valve unit 20 can be removed easily for maintenance and replacement. When the retaining hooks 115 are disposed respectively at the open ends 222' of the retaining grooves 222, each of the guide passages 123 is misaligned from the corresponding water-guiding hole 114, as shown in FIG. 7. As such, the guide passages 123 are not in fluid communication with the corresponding water-guiding holes 114, respectively, to thereby prevent outflow of water through the water outlet 211.

With this invention thus explained, it is apparent that numerous modifications and variations can be made without departing from the scope and spirit of this invention. It is therefore intended that this invention be limited only as indicated by the appended claims.

I claim:

1. A faucet adapted to be mounted to a deck and adapted to be communicated fluidly with at least one conduit, said faucet comprising:

a mounting unit including a fixed seat adapted to be disposed fixedly on the deck and formed with at least one water-guiding hole and a plurality of inverted L-shaped retaining hooks disposed around said water-guiding hole, and a rotatable seat disposed rotatably on said fixed seat and having at least one tubular projection formed with a guide passage; and a valve unit including a housing including a water outlet at a top end portion thereof, an opening disposed below said water outlet, and a spacer plate disposed fixedly in said housing and below said opening, a coupling member co-rotatable with said rotatable seat and disposed fixedly in said housing, said coupling member including a top wall attached fixedly to said spacer plate, a plurality of L-shaped retaining grooves engaging respectively said retaining hooks, a through hole aligned with said tubular projection, a first water seal disposed between said top wall and said housing so as to establish a liquid tight seal therebetween, and a second water seal, each of said retaining grooves having an open end and a closed end, a valve seat disposed fixedly in said housing, said second water seal being disposed between said valve seat and said top wall so as to establish a liquid tight seal therebetween, said valve seat having a connecting portion extending through said through hole in said coupling member, and a water inlet in fluid communication with said guide passage and said water outlet, an electromagnetic valve disposed on said valve seat and between said water outlet and said water inlet for controlling outflow of water through said water outlet, and an infrared sensor connected electrically to said electromagnetic valve for controlling activation and deactivation of said electromagnetic valve;

wherein, when said lock unit is operated to allow for rotation of said valve unit relative to said fixed seat, through operation of said valve unit, said retaining hooks are movable respectively into said closed ends of said retaining grooves so that said guide passage is in fluid communication with said water-guiding hole and so as to lock said valve unit relative to said fixed seat, and into said open ends of said retaining grooves so that said guide passage is not in fluid communication with said water-guiding hole and so as to allow for removal of said valve unit from said mounting unit.

2. The faucet as claimed in claim 1, wherein said mounting unit further includes:

an upper plate adapted to be disposed on and above the deck;

a lower plate adapted to be disposed immediately under the deck;

a first bolt extending through said lower plate and connected fixedly to said fixed seat;

a nut engaging said first bolt;

a positioning plate disposed under said lower plate and permitting said first bolt to extend fittingly therethrough, said positioning plate being disposed on and above said nut; and two second bolts threaded in said positioning plate and adapted for pressing said lower plate against the deck.

3. The faucet as claimed in claim 2, wherein said lower plate is formed with a stop block abutting against said positioning plate so as to prevent rotation of said positioning plate about said first bolt.

4. The faucet as claimed in claim 1, wherein:

said fixed seat further includes a recess aligned with said water-guiding hole;

said rotatable seat further has a disk portion received fittingly and rotatably within said recess, said tubular projection projecting from said disk portion;

said mounting unit further includes a rubber cap received fittingly within a top end of said water-guiding hole and having an annular top end wall defining an aperture, a resilient member for biasing said top end wall of said rubber cap to press against said disk portion such that said water-guiding hole is in fluid communication with said guide passage through said aperture, and a C-shaped retaining ring disposed between said rotatable seat and said fixed seat for positioning said rotatable seat relative to said fixed seat.

5. The faucet as claimed in claim 1, wherein said valve unit further includes a battery set disposed in said housing for supplying electricity to said electromagnetic valve and said infrared resistor.

6. The faucet as claimed in claim 1, wherein said valve unit further includes a third water seal disposed in said opening and between said infrared sensor and said housing so as to establish a liquid tight seal therebetween.

* * * * *